US008038277B2

(12) United States Patent
Kanbe

(10) Patent No.: US 8,038,277 B2
(45) Date of Patent: Oct. 18, 2011

(54) INK CARTRIDGES AND METHODS OF ADJUSTING PRESSURE IN AN INK CHAMBER OF SUCH INK CARTRIDGES

(75) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 437 days.

(21) Appl. No.: 12/258,790

(22) Filed: Oct. 27, 2008

(65) Prior Publication Data

US 2009/0141055 A1 Jun. 4, 2009

(30) Foreign Application Priority Data

Nov. 30, 2007 (JP) ..... 2007-311803

(51) Int. Cl.
*B41J 2/175* (2006.01)
*B41J 29/393* (2006.01)

(52) U.S. Cl. ..... 347/86; 347/19; 347/84; 347/85

(58) Field of Classification Search ..... 347/19, 347/86

See application file for complete search history.

(56) References Cited

U.S. PATENT DOCUMENTS

| | | | | |
|---|---|---|---|---|
| 7,192,128 | B1 * | 3/2007 | Hattori et al. | 347/86 |
| 7,316,471 | B2 | 1/2008 | Hattori et al. | |
| 2001/0017641 | A1 * | 8/2001 | Kobayashi et al. | 347/85 |
| 2002/0093556 | A1 * | 7/2002 | Ishizawa et al. | 347/86 |
| 2003/0030707 | A1 * | 2/2003 | Sasaki | 347/86 |
| 2003/0142183 | A1 | 7/2003 | Rodriguez Mojica et al. | |
| 2005/0174397 | A1 * | 8/2005 | Scardovi et al. | 347/85 |

FOREIGN PATENT DOCUMENTS

| | | | |
|---|---|---|---|
| CN | 2905440 | Y | 5/2007 |
| EP | 1170135 | A1 | 1/2002 |
| JP | 2007-196647 | A | 8/2007 |

OTHER PUBLICATIONS

The State Intellectual Property Office of the People's Republic of China; Notification of First Office Action in Chinese Patent Application No. 200810177423.5 mailed Feb. 12, 2010.

European Patent Office, European Search Report for Related EP Application No. 08003694, dated Jul. 10, 2008.

* cited by examiner

*Primary Examiner* — Ryan Lepisto
(74) *Attorney, Agent, or Firm* — Baker Botts L.L.P.

(57) ABSTRACT

An ink cartridge includes a case including an ink chamber defined in the case and configured to store ink, and a first wall facing an exterior of the case. The first wall has a first opening formed therethrough, and a second opening formed therethrough. The first opening is configured to introduce air into an interior of the ink chamber, and the second opening is configured to supply ink from an interior of the case to the exterior of the case. The case also includes a second wall facing the exterior of the case and positioned opposite the first wall, and a third wall positioned in the case and defining a portion of the ink chamber. The third wall has a third opening formed therethrough, and the third opening is positioned closer to the second wall than to the first wall. Moreover, the case includes a particular ink path extending from the second opening to the third opening. The particular ink path is in fluid communication with the ink chamber via the third opening.

19 Claims, 6 Drawing Sheets

INK CARTRIDGES AND METHODS OF ADJUSTING PRESSURE IN AN INK CHAMBER OF SUCH INK CARTRIDGES

CROSS-REFERENCE TO RELATED APPLICATION

The present application claims priority from Japanese Patent Application No. JP-2007-311803, which was filed on Nov. 30, 2007, the disclosure of which is incorporated herein by reference in its entirety.

BACKGROUND OF THE INVENTION

1. Field of the Invention

The present invention relates generally to ink cartridges and methods of adjusting a pressure in an ink chamber of such ink cartridges. More specifically, the present invention is directed toward ink cartridges comprising an ink path, and methods of adjusting a pressure in an ink chamber of such an ink cartridges.

2. Description of Related Art

A known ink cartridge is configured to be removably mounted to a known inkjet printer. The known ink cartridge has an ink chamber configured to store ink therein, an ink supply portion configured to supply ink from an interior of the ink chamber to an exterior of the ink chamber. The known inkjet printer has a recording head, and when the known ink cartridge is mounted to the known inkjet printer, ink stored in the ink chamber is supplied to the known inkjet printer via an ink supply portion to the recording head.

When the known ink cartridge is manufactured, air bubbles may remain in the ink supply portion during a process in which the ink chamber is filled with ink. Moreover, in order to remove air dissolved in the ink, the known ink cartridge may be packed in a packaging bag under a pressure which is less than the atmospheric pressure.

Another known ink cartridge, such as the ink cartridge described in JP-A-2007-196647, has a pivotable member disposed in the ink chamber, and the pivotable member pivots in accordance with the amount of ink in the ink chamber. One end of the pivotable member is detected by an optical sensor, whereby it is determined whether the amount of ink in the ink chamber is less than a predetermined amount of ink.

In the another known ink cartridge, the pressure in the ink chamber of an unused ink cartridge is less than the atmospheric pressure. Before the another known ink cartridge is used, the ink chamber is brought into fluid communication with the atmosphere, such that the pressure in the ink chamber becomes equal to the atmospheric pressure. When the pressure in the ink chamber is less than the atmospheric pressure, the air bubbles in the ink supply portion are relatively large. When the pressure in the ink chamber is increased to be equal to the atmospheric pressure, the air bubbles shrink, i.e., the volume of the air bubbles decreases. Therefore, in order to compensate for the volume decrease, ink and/or air flow from the ink chamber into the ink supply portion. The another known ink cartridge has a path extending from the ink chamber to the ink supply portion. When an end of the path, which end is continuous with the ink chamber, is submerged in ink, ink flows into the ink supply portion via the path. When the end of the path is positioned in air, air flows into the ink supply portion via the path. Such air may be supplied to the recording head, which may lead to a printing failure.

Moreover, when the amount of ink in the ink chamber decreases, one end of the pivotable member approaches to the bottom surface of the ink chamber. When this occurs, ink may be held in a gap formed between the one end of the pivotable member and the bottom surface by the surface tension of the ink. This ink is not dispensed from the ink cartridge, and is discarded when the ink cartridge is discarded.

SUMMARY OF THE INVENTION

Therefore, a need has arisen for ink cartridges, and methods of adjusting a pressure in an ink chamber of such ink cartridges, which overcome these and other shortcomings of the related art. A technical advantage of the present invention is that an increase in an amount of air in an ink supply portion is prevented. Another technical advantage of the present invention is that ink in an ink chamber is consumed more efficiently.

According to an embodiment of the present invention, an ink cartridge comprises a case comprising an ink chamber defined in the case and configured to store ink, and a first wall facing an exterior of the case. The first wall has a first opening formed therethrough, and a second opening formed therethrough. The first opening is configured to introduce air into an interior of the ink chamber, and the second opening is configured to supply ink from an interior of the case to the exterior of the case. The case also comprises a second wall facing the exterior of the case and positioned opposite the first wall, and a third wall positioned in the case and defining a portion of the ink chamber. The third wall has a third opening formed therethrough, and the third opening is positioned closer to the second wall than to the first wall. Moreover, the case comprises a particular ink path extending from the second opening to the third opening. The particular ink path is in fluid communication with the ink chamber via the third opening.

According to another embodiment of the present invention, a method of adjusting a pressure in an ink chamber of an ink cartridge is described. In this embodiment of the present invention, the ink cartridge comprises the ink chamber, and a first wall having a first opening and a second opening formed therethrough. The first opening is configured to introduce air into an interior of the ink chamber from an atmosphere, and the second opening is configured to supply ink from the interior of the ink chamber to an exterior of the ink chamber. The ink cartridge also comprises a second wall positioned within the ink chamber and defining a portion of the ink chamber. The second wall has a third opening formed therethrough. Moreover, the ink cartridge comprises a particular ink path extending from the third opening to the second opening, in which the particular ink path is in fluid communication with the ink chamber via the third opening, a first valve configured to selectively cover and uncover the first opening and a second valve configured to selectively cover and under the second opening. The method comprises the steps of orienting the ink cartridge, such that the first wall is positioned at a top of the ink cartridge, and submerging the third opening in ink. The method also comprises the step of introducing air into the interior of the ink chamber from the atmosphere via the first opening by moving the first valve to uncover the first opening while the second opening is covered by the second valve. Moreover, the method comprises the step of drawing ink from the ink chamber to a position adjacent to the second opening via the particular ink path.

According to yet another embodiment of the present invention, an ink cartridge comprises a case comprising an ink chamber defined in the case and configured to store ink, and a first wall facing an exterior of the case. The first wall has a first opening formed therethrough, and the first opening is configured to supply ink from an interior of the case to the exterior of the case. The case also comprises a second wall positioned in the case and defining a bottom portion of the ink chamber when the ink cartridge is used. The second wall has a second opening formed therethrough. Moreover, the case comprises a particular ink path extending from the first opening to the second opening, in which the particular ink path is in fluid communication with the ink chamber via the second opening, and a movable member positioned in the ink chamber and configured to move within the ink chamber based on an amount of ink in the ink chamber. In addition, at least a portion of the second opening is aligned with a portion of the movable member in a gravitational direction and the second opening is positioned below the movable member when the ink cartridge is used.

According to still another embodiment of the present invention, an ink cartridge comprises a case comprising an ink chamber defined in the case and configured to store ink and a first wall facing an exterior of the case. The first wall has a first opening formed therethrough, and the first opening is configured to supply ink from an interior of the case to the exterior of the case. The case also comprises a second wall facing the exterior of the case and positioned opposite the first wall, a third wall facing the exterior of the case and extending between the first wall and the second wall, and a fourth wall positioned in the case and defining a portion of the ink chamber. The fourth wall has a second opening formed therethrough. Moreover, the case comprise a particular ink path extending from the first opening to the second opening. The particular ink path is in fluid communication with the ink chamber via the second opening. The ink cartridge also comprises a movable member positioned in the ink chamber and configured to move within the ink chamber based on an amount of ink in the ink chamber. The second opening is positioned closer to the third wall than the movable member is positioned to the third wall, and at least a portion of the second opening is aligned with a portion of the movable member in a direction perpendicular to the third wall.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-6, like numerals being used for like corresponding portions in the various drawings.

Figure 1:
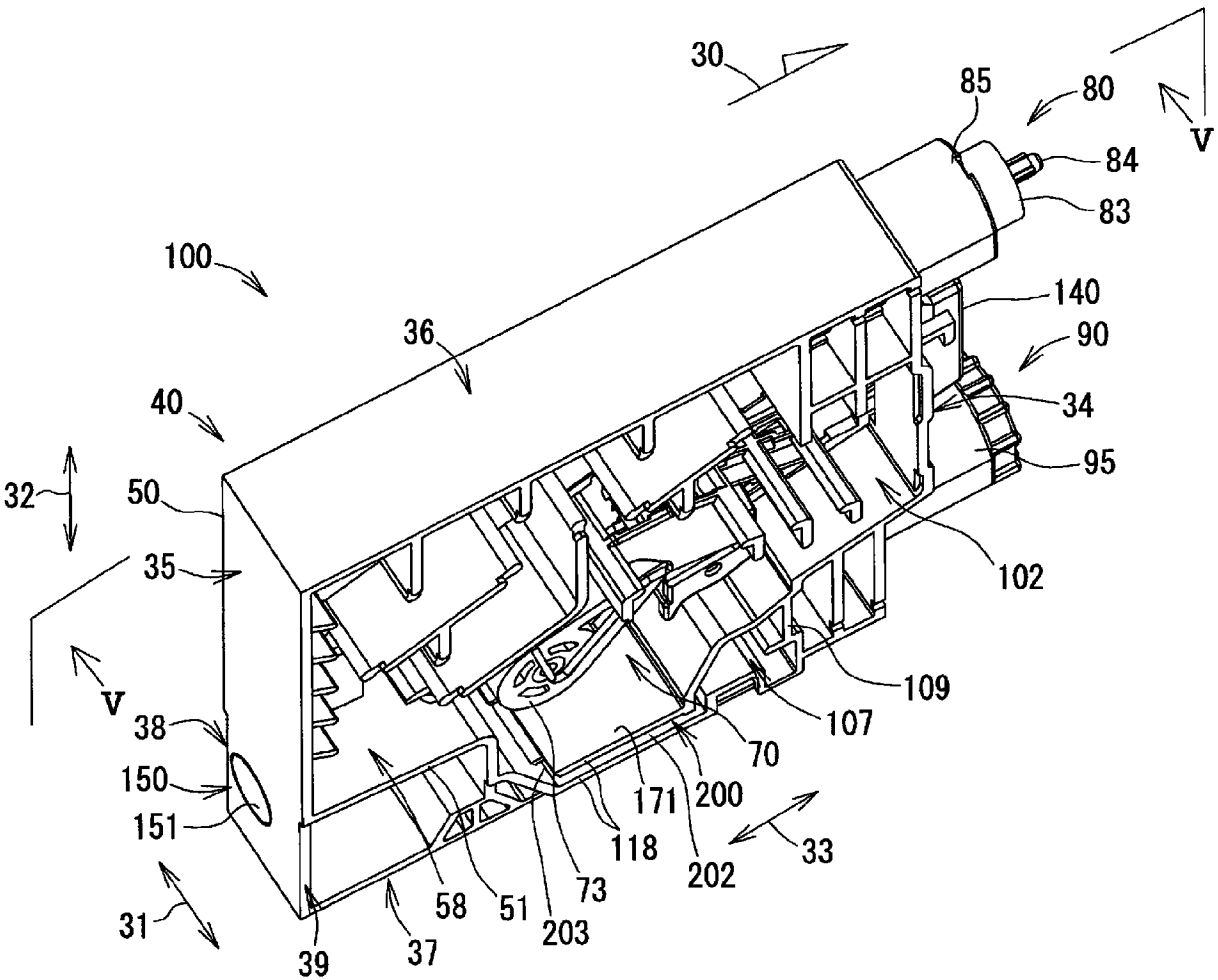
FIG. 1 is a perspective view of an ink cartridge, according to an embodiment of the present invention.
Figure 2:
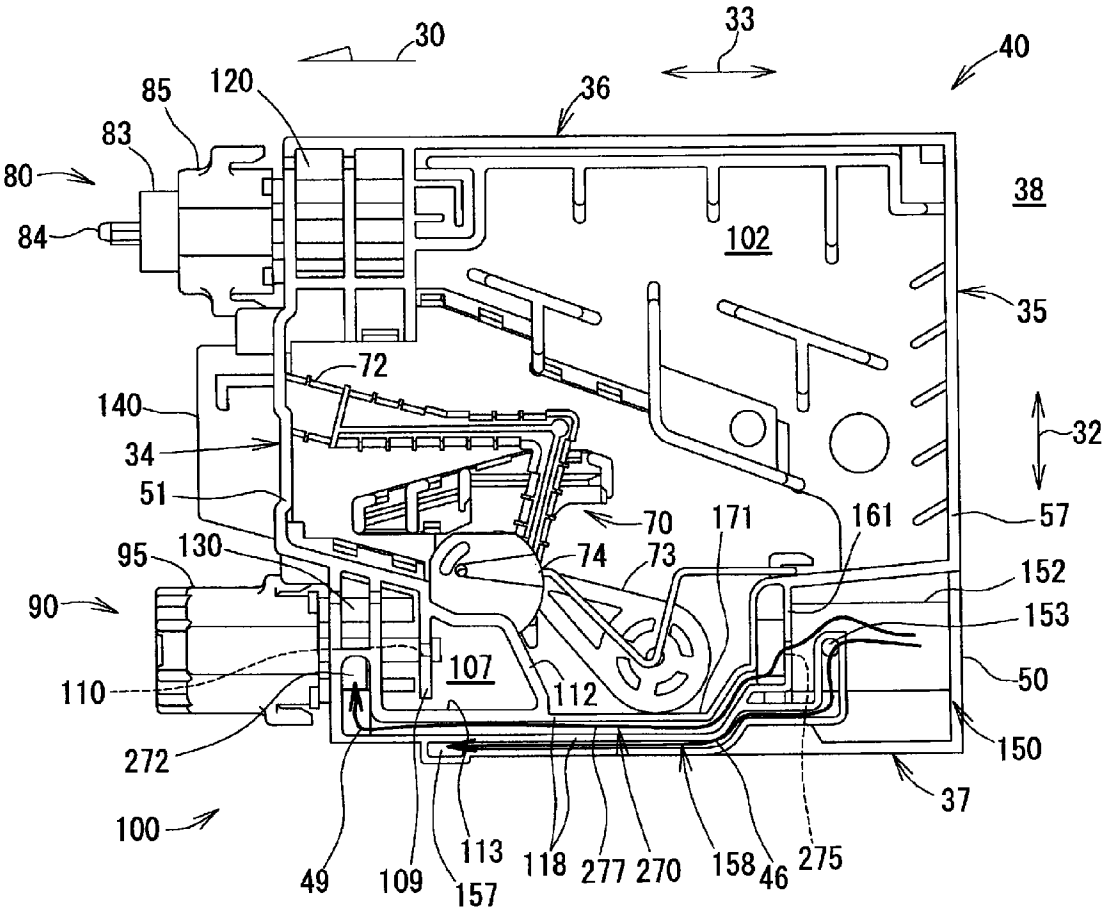
FIG. 2 is a left side view of the ink cartridge of FIG. 1.
Figure 3:
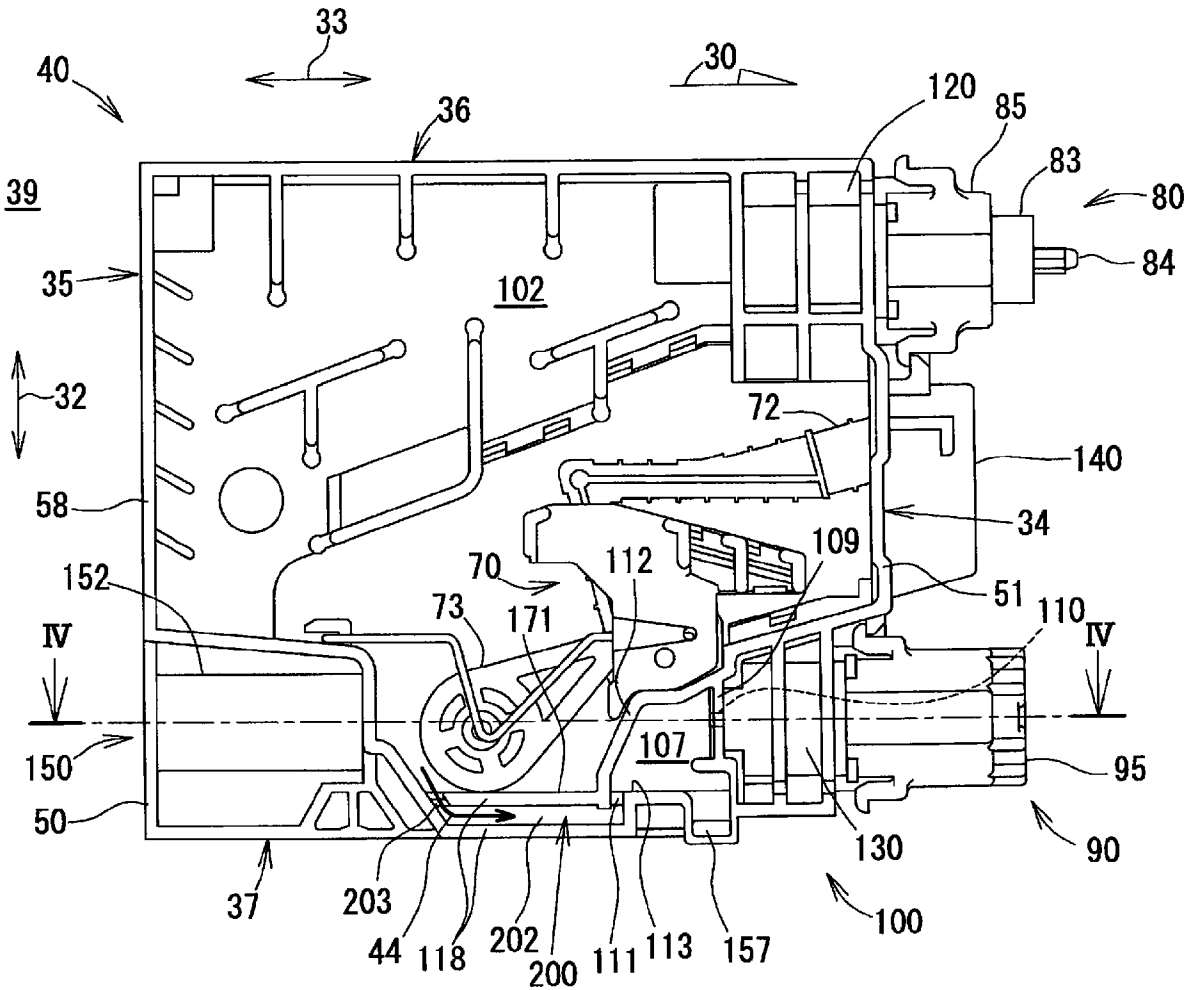
FIG. 3 is a right side view of the ink cartridge of FIG. 1.

Referring to FIGS. 1-3, an ink cartridge 100 according to an embodiment of the present invention is described. The ink cartridge 100 may be configured to be used with an image recording apparatus (not shown), such as an inkjet printer. The ink cartridge 100 may have a flattened, substantially rectangular parallelepiped shape having a width in a width direction 31, a height in a height direction 32, and a depth in a depth direction 33. The ink cartridge 100 may be configured to be inserted into a cartridge mounting portion (not shown) of the image recording apparatus in an insertion direction 30, which is parallel to the depth direction 33. When the ink cartridge 100 is mounted to the cartridge mounting portion, a surface of the ink cartridge 100 positioned at the top of the ink cartridge 100 in FIGS. 1-3 is positioned above another surface of the ink cartridge 100 positioned at the bottom of the ink cartridge 100 in FIGS. 1-3.

The ink cartridge 100 may comprise a case 40, and the case 40 may comprise a front wall 34, a rear wall 35 positioned opposite the front wall 34, a top wall 36 extending between the front wall 34 and the rear wall 35, a bottom wall 37 extending between the front wall 34 and the rear wall 35 and positioned opposite the top wall 36, a left side wall 38 extending between the front wall 34 and the rear wall 35, and a right side wall 39 extending between the front wall 34 and the rear wall 35 and positioned opposite the left side wall 38. Each of the front wall 34, the rear wall 35, the top wall 36, the bottom wall 37, the left side wall 38, and the right side wall 39 faces the exterior of the case 40, and defines the outer appearance of the case 40. When the ink cartridge 100 is inserted into the cartridge mounting portion, the case 40 is inserted from a front wall 34 side. When the ink cartridge 100 is mounted to the cartridge mounting portion and is used, the top wall 36 is positioned at the top of the ink cartridge 100 and the bottom wall 37 is positioned at the bottom of the ink cartridge 100. Each of an area of the left side wall 38 and an area of the right side wall 39 is greater than each of an area of the front wall 34, an area of a rear wall 35, an area of the top wall 36, and an area of the bottom wall 37.

The ink cartridge 100 may comprise an air introduction portion 80, an ink supply portion 90, and a pivotable member 70. Each of the air introduction portion 80, the ink supply portion 90, and the pivotable member 70 may comprise a resin material. The ink cartridge 100 may comprise an outer case (not shown) covering substantially the entirety of the case 40, or a protector (not shown) covering the ink supply portion 90.

The case 40 may comprise a frame 50 and a pair of films (not shown). The frame 50 may comprise the front wall 34, the rear wall 35, the top wall 36, and the bottom wall 37. The pair of films may comprise the left side wall 38 and the right side wall 39.

The frame 50 may comprise a translucent resin material, e.g., a transparent or semi-transparent resin material, such as polyacetal, nylon, polyethylene, polypropylene, or the like, and may be manufactured by injection molding the resin material.

The frame 50 may comprise an outer peripheral wall 51 having substantially a rectangular profile forming a space inside. The frame 50 may comprise at least a portion of the front wall 34, at least a portion of the top wall 36, at least a portion of the rear wall 35, and at least a portion of the bottom wall 37. As a result, a pair of openings 57 and 58 may be formed at widthwise ends of the frame 50, respectively.

The pair of film may be attached, e.g., welded or bonded with adhesive, to the widthwise ends of the outer peripheral wall 51, respectively, such that the openings 57 and 58 are covered by the pair of films, respectively. The outer peripheral wall 51 and the pair of films define an ink chamber 102 therein. The ink chamber 102 may be configured to store ink therein. In another embodiment, a frame may be a container having six rigid walls, and an ink chamber may be formed in the container.

The case 40 may comprise a detection portion 140 extending from the front wall 34 away from the ink chamber 120. The amount of ink stored in the ink chamber 102 may be visually or optically detected via the detection portion 140. The detection portion 140 may be integral with the frame 50. Therefore, the detection portion 140 may comprise the same material as the frame 50, i.e., a translucent resin material, e.g., a transparent or semi-transparent resin material. Light may pass through the detection portion 140

Figure 5:
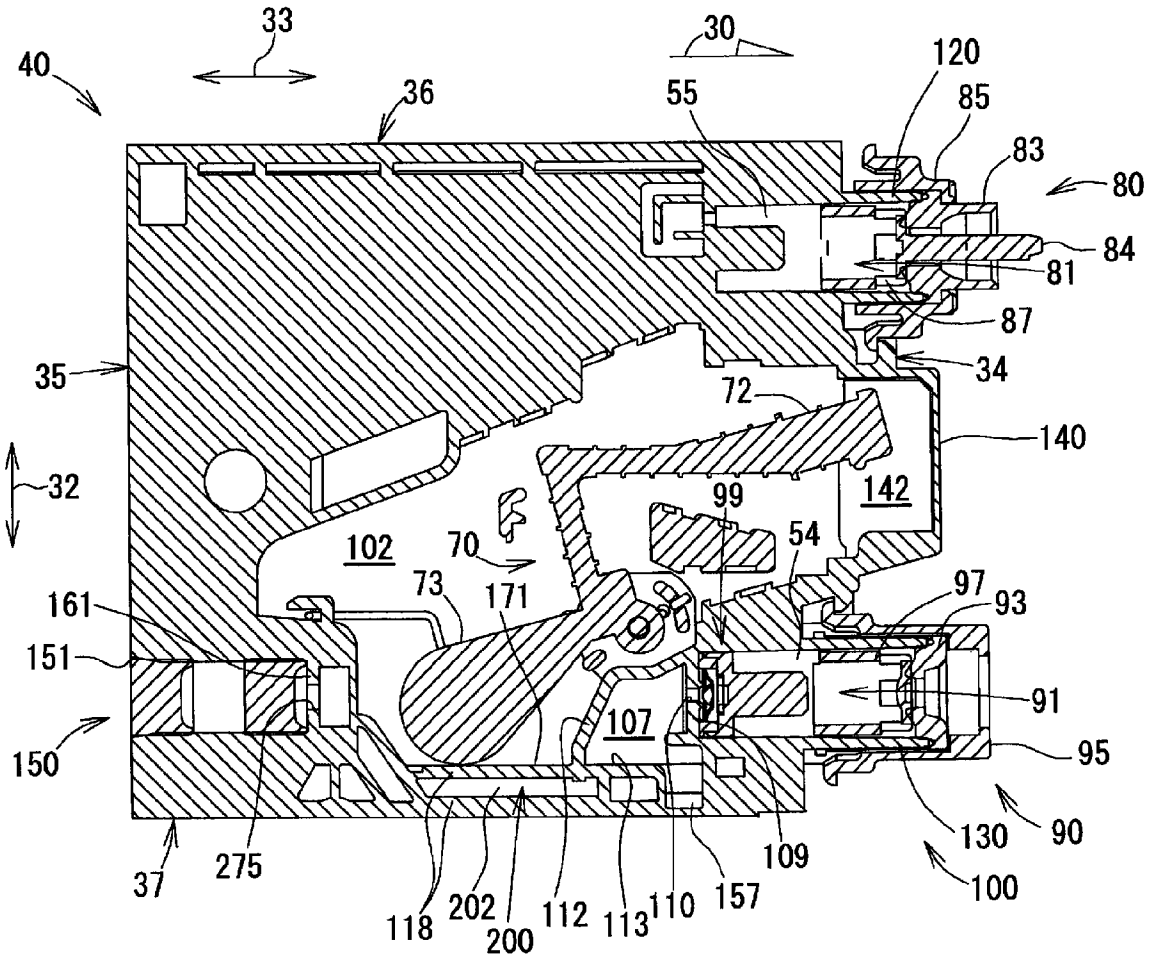
FIG. 5 is a cross-sectional view taken along V-V line in FIG. 1.

The detection portion 140 may be positioned between the air introduction portion 80 and the ink supply portion 90, and extends outward from the front wall 34. The detection portion 140 may have substantially a rectangular, parallelepiped shape, and may comprise five rectangular walls. Referring to FIG. 5, the detection portion 140 may have an inner space 142 defined by the five rectangular walls inside the detection portion 140. The inner space 142 may be continuous with the ink chamber 102.

When the ink cartridge 100 is mounted to the cartridge mounting portion, the detection portion 140 may be positioned in an optical path of an optical sensor, e.g., a photo-interrupter, of the cartridge mounting portion. The detection portion 140 may comprise an irradiation portion positioned at one of the five rectangular walls, which wall extends in the height direction 32, and the optical path intersects the irradiation portion.

Referring to FIGS. 2-5, the pivotable member 70 may be positioned in the ink chamber 102. The pivotable member 70 may comprise an opaque resin material. The pivotable member 70 may be pivotably supported by a rib 74 which extends from the outer peripheral wall 51 into the ink chamber 102. The pivotable member 70 may comprise a float portion 73 positioned at one end of the pivotable member 70. The pivotable member 70 also may comprise an indicator portion 72 positioned at the other end of the pivotable member 70 opposite the one end of the pivotable member, and the indicator portion 72 selectively may be positioned in the inner space 142. The specific gravity of the float portion 73 may be less that the specific gravity of ink stored in the ink chamber 102, and therefore, the float portion 73 may float on ink. When the float portion 73 moves up and down based on the amount of ink stored in the ink chamber 102, the pivotable member 70 pivots, and the indicator portion 72 moves up and down in the inner space 142 according to the movement of the pivotable member 70. By detecting the position of the indicator portion 72 via the detection portion 140 with the optical sensor, it may be determined whether the amount of ink stored in the ink chamber 102 is greater than or equal to a sufficient amount of ink.

Referring to FIG. 5, the air introduction portion 80 may comprise a circular opening (not numbered) formed through the front wall 34 between the detection portion 140 and the top wall 36. The air introduction portion 80 may comprise a cylindrical air introduction chamber 55 formed in the frame 50, and the air introduction chamber 55 maybe continuous with the opening of the air introduction portion 80. The air introduction chamber 55 extends from the opening toward the ink chamber 102 in the depth direction 33. The air introduction chamber 55 may be in fluid communication with the ink chamber 102.

The air introduction valve mechanism 80 may comprise a valve 87, a spring (not shown), a sealing member 83, and a cap 85. The air introduction portion 80 may be configured to selectively allow and prevent fluid communication between the ink chamber 102 and the exterior of case 40 via the air introduction chamber 55. The valve 87 may comprise a rod 84.

The seal member 83 may be positioned at a portion of the frame 50 defining the opening of the air introduction portion 80. The cap 85 supports the seal member 83, and the seal member 83 may be sandwiched between the cap 85 and the portion of the frame 50 defining the opening of the air introduction portion 80. Each of the cap 85 and the seal member 83 may have an opening (not numbered) formed through the cap 85 and the sealing member 83, respectively, in the depth direction 33. The openings of the cap 85 and the seal member 83 may form an air introduction port 81 through which the air introduction chamber 55 is configured to be in fluid communication with the exterior of the case 40. The valve 87 and the spring may be positioned in the air introduction chamber 55. The rod 84 extends from the interior of the air introduction chamber 55 to the exterior of the case 40 via the air introduction port 81. When no external force is applied to the rod 84, the valve 87 contacts the seal member 83 being biased by the spring, such that the opening of the seal member 83 is covered by the valve 87, i.e., the air introduction port 81 is covered by the valve 87. When the opening of the seal member 83 is covered by the valve 87, fluid communication between the atmospheric air introduction chamber 55 and the exterior of the case 40 may be prevented. When an external force is applied to the rod 84 toward the air introduction chamber 55 against the biasing force of the spring, the valve 87 separates from the seal member 83, such that the opening of the seal member 83 is uncovered i.e., the air introduction port 81 is uncovered. When the opening of the seal member 83 is uncovered, the fluid communication between the atmospheric air introduction chamber 55 and the exterior of the case 40 may be allowed.

Referring to FIG. 5, the ink supply portion 90 may comprise a circular opening (not numbered) formed through the front wall 34 between the detection portion 140 and the bottom wall 37. The ink supply portion 90 may comprise a cylindrical ink supply chamber 54 formed in the frame 50, and the ink supply passage 55 may be continuous with the opening of the ink supply portion 90. The ink supply chamber 54 extends from the opening toward the ink chamber 102 in the depth direction 33. The case 40 may comprise an ink supply sub-chamber 107 positioned adjacent to the ink supply chamber 54 in the depth direction 33. The ink supply sub-chamber 107 may be positioned between the ink supply chamber 54 and the rear wall 35. The outer peripheral wall 51 may comprise a partition wall 109, and the ink supply chamber 54 and the ink supply sub-chamber 107 may be partitioned by the partition wall 109. An opening 110 may be formed through the partition wall 109 in the depth direction 33. The ink supply sub-chamber 107 and the ink supply chamber 54 may be in fluid communication via the opening 110.

The ink supply chamber 54 may be partitioned from the ink chamber 102 by a substantially cylindrical side wall 130. The ink supply chamber 54 may be in fluid communication with the ink chamber 102 via the ink supply sub-chamber 107 and an ink path 200 which extends from the ink supply sub-chamber 107 to the ink chamber 102.

The ink supply portion 90 may comprise a valve 97 positioned slidably in the ink supply chamber 54, a seal member 93 positioned at a portion of the frame 50 defining the opening of the ink supply portion 90, a cap 95 supporting the seal member 93, a spring (not shown) positioned in the ink supply chamber 54 and configured to bias the valve 97 toward the seal member 93, and a regulation valve 99. The seal member 93 may be sandwiched between the cap 95 and the portion of the frame 50 defining the opening of the ink supply portion 90. The ink supply valve mechanism 90 may be configured to selectively allow and prevent fluid communication between the ink chamber 102 and the exterior of case 40 via the ink supply chamber 54. An opening (not numbered) may be formed through each of the cap 95 and the seal member 93, and the openings of the cap 95 and the seal member 93, respectively, may form an ink supply port 91 through which the ink supply chamber 54 is configured to be in fluid communication with the exterior of the case 40. When no external force is applied to the valve 97, the valve 97 contacts the seal member 93 being biased by the spring 96, such that the opening of the seal member 93 is covered by the valve 97, i.e., the ink supply port 91 is covered by the valve 97. When the opening of the seal member 93 is covered by the valve 97, fluid communication between the ink supply chamber 54 and the exterior of the case 40 maybe prevented. When an ink pipe of the image recording apparatus is inserted into the ink supply port 91 and the ink pipe contacts and pushes the valve 97 toward the ink introduction passage 55 against the biasing force of the spring, the valve 97 separates from the seal member 93, such that the opening of the seal member 93 is uncovered, i.e., the ink supply port 91 is uncovered. When the ink pipe is inserted into the ink supply port 91, the ink supply chamber 54 communicates with the interior of the ink pipe, whereby ink may be supplied to a recording head of the image recording apparatus.

The regulation valve 99 may be positioned at an end of the ink supply chamber 54 opposite the opening of the ink supply portion 90. The regulation valve 99 may be configured to regulate the flow rate of ink passing through the opening 110. The regulation valve 99 may be configured to prevent rapid counter flow of ink from the ink supply chamber 54 via the opening 110 to the ink supply sub-chamber 107.

Referring to FIG. 2, an opening 272 may be formed through the side wall 130 defining the ink supply chamber 54. The opening 272 may be formed at the left side of the side wall 130. One end of a bypass 270 may be continuous with the opening 272.

Referring to FIGS. 2-5, the ink supply sub-chamber 107 may be defined by a partition wall 112, the partition wall 109, a bottom wall 118 forming a bottom surface 171 and defining a lower portion of the ink chamber 102, and the pair of films covering the widthwise ends of the frame 50. More specifically, the pair of films may be attached, e.g., welded or bonded with adhesive, to the widthwise ends of the partition wall 112, the partition wall 109, and the bottom wall 118, and a space surrounded by these walls and the pair of films may be the ink supply sub-chamber 107. The volume of the ink supply sub-chamber 107 may be less than the volume of the ink supply chamber 54. The outer peripheral wall 51 may comprise the partition wall 112, the partition wall 109, and the bottom wall 118.

The partition wall 112 covers the opening 110 from the ink chamber 102. The partition wall 112 may have a substantially semi-arch shape extending between the partition wall 109 and the bottom wall 118, and one end of the partition wall 112 may be connected to the partition wall 109 and the other end of the partition wall 112 may be connected to the bottom wall 118.

Referring to FIG. 3, an opening 111 may be formed through a bottom surface 113 of the ink supply sub-chamber 107. The opening 111 may be formed at the right side of the bottom surface 113. The ink path 200 extends from the opening 111 in the depth direction 33.

The ink path 200 may be positioned below the bottom surface 171 of the ink chamber 102. The ink path 200 may be defined by a groove 202 formed in the right side end of the bottom wall 118 and the film attached to the end of the bottom wall 118.

Figure 4:
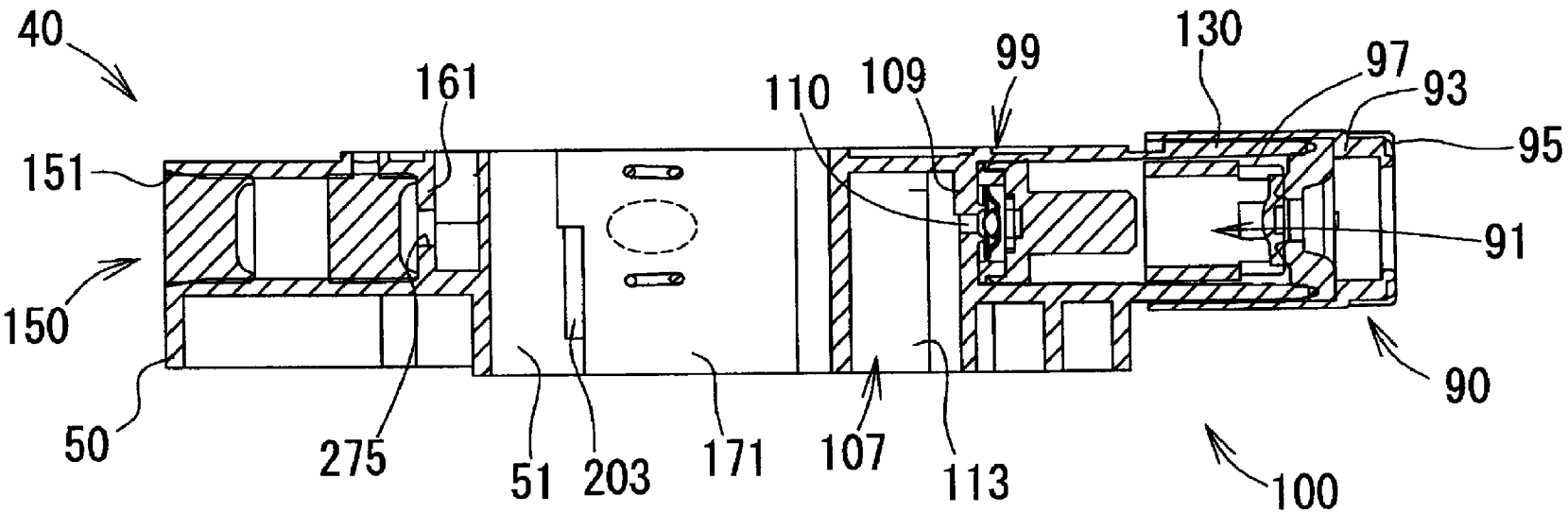
FIG. 4 is a cross-sectional view taken along line IV-IV line in FIG. 3.

The ink path 200 reaches an end of the bottom wall 118 positioned at the rear wall 35 side. An opening 203 may be formed through the end of the bottom wall 118 positioned at the rear wall 35 side. The opening 203 may be positioned closer to the rear wall 35 than to the front wall 34. The opening 203 may extend from the ink path 220 to the ink chamber 102, such that the ink path 200 may be in fluid communication with the ink chamber 102 via the opening 203. Referring to FIGS. 3 and 4, the opening 203 may be positioned adjacent to a portion of the bottom surface 171 which may selectively may be in contact a bottom portion of the float portion 73, i.e., positioned adjacent to a portion surrounded by a broken line in FIG. 4. Moreover, at least a portion of opening 203 may be aligned with a portion of the float portion 73 in the height direction 32. When the ink cartridge 100 is mounted to the cartridge mounting portion of the image recording apparatus and is used, the height direction 32 corresponds to the gravitational direction. Therefore, when the ink cartridge 100 is used, at least a portion of opening 203 may be aligned with a portion of the float portion 73 in the gravitational direction and the opening 203 may be positioned below the float portion 73. The opening 203 is positioned closer to the bottom wall 37 than the float portion 73 is positioned to the bottom wall 37, and at least portion of opening 203 may be aligned with a portion of the float portion 73 in a direction perpendicular to the bottom wall 37.

The ink chamber 102 may be in fluid communication with the ink supply chamber 54 via the opening 203, the ink path 200, the opening 111, the ink supply sub-chamber 107, and the opening 110.

Referring to FIGS. 2-5, the case 40 may comprise an ink fill portion 150 positioned at the rear wall 35. The ink fill portion 150 may be positioned closer to the bottom wall 37 than to the top wall 36. Ink may be introduced from the ink fill portion 150 into the ink chamber 102. After the ink chamber 102 is filled with ink, the ink fill portion 150 may be hermetically sealed while the pressure in the ink chamber 102 is less than the atmospheric pressure. Accordingly, the pressure in the ink chamber 102 of the unused ink cartridge 100 may be maintained at a pressure which is less than the atmospheric pressure.

The ink fill portion 150 may comprise a opening 151 formed through the rear wall 35, and a cylindrical chamber 152 extending from the opening 151 toward the ink chamber 102 in the depth direction 33. An end of the cylindrical chamber 152 opposite the opening 151 may be defined by a partition wall 161. Ink may be introduced from the opening 151 into the cylindrical chamber 152.

An opening 153 may be formed through the left side portion of the side wall of the cylindrical chamber 152.

A fill path 158 extends from the opening 153. The fill path 158 may be formed at the left side of the frame 50. The fill path 158 extends toward the bottom wall 37 from the opening 153 of the cylindrical chamber 152, and further extends toward the front wall 34 in parallel to the bottom wall 37 below the ink path 200. An end of the fill path 158 may be continuous with an opening 157 formed below the ink supply sub-chamber 107. The opening 157 extends from the left side of the frame 50 to the right side of the frame 50, and may be continuous with the ink supply sub-chamber 107 at the right side of the frame 50. The ink fill portion 150 and the ink supply sub-chamber 107 may be in fluid communication via the fill path 158.

The bypass 270 may be formed at the left side of the frame 50. An opening 275 may be formed through the partition wall 161 defining the end of the cylindrical chamber 152. The bypass 270 extends from the opening 275 toward the bottom surface 171 of the ink chamber 102 and further extend toward the front wall 34 in parallel to the bottom wall 37. An end of the bypass 270 may be continuous with an opening 272 formed through the side wall 130 of the ink supply chamber 54. The bypass 270 may be in fluid communication with the ink supply chamber 54 via the opening 272.

The bypass 270 may be defined by a groove 277 formed at the left side end of the outer peripheral wall 51 comprising the bottom wall 118 and by the film attached to the end of the outer peripheral wall 51.

Ink introduced from the opening 151 flows into the ink chamber 102 via the fill path 158, as indicated by an arrow 46 in FIG. 2, and via the bypass 270 and the ink supply chamber 54, as indicated by an arrow 49 of FIG. 2.

More specifically, when ink is introduced from the opening 151 when the ink supply port 91 is covered by the valve 97, the ink flows from the interior of the cylindrical chamber 152 into each of the opening 153 and the opening 275 The ink passing through the opening 153 flows into the fill path 158, passes through the fill path 158 toward the front wall 34 side, and reaches the opening 157, as indicated by the arrow 46. Then, the ink passes through the ink supply sub-chamber 107 and the ink path 200, and finally flows into the ink chamber 102.

The ink passing through the opening 275 passes through the bypass 270 and toward the front wall 34, as indicated by the arrow 49. Then, the ink passes through the opening 272 into the ink supply chamber 54. The ink in the ink supply chamber 54 flows from the opening 110 into the ink supply sub-chamber 107, passes through the ink path 200, and finally flows into the ink chamber 102.

Figure 6:
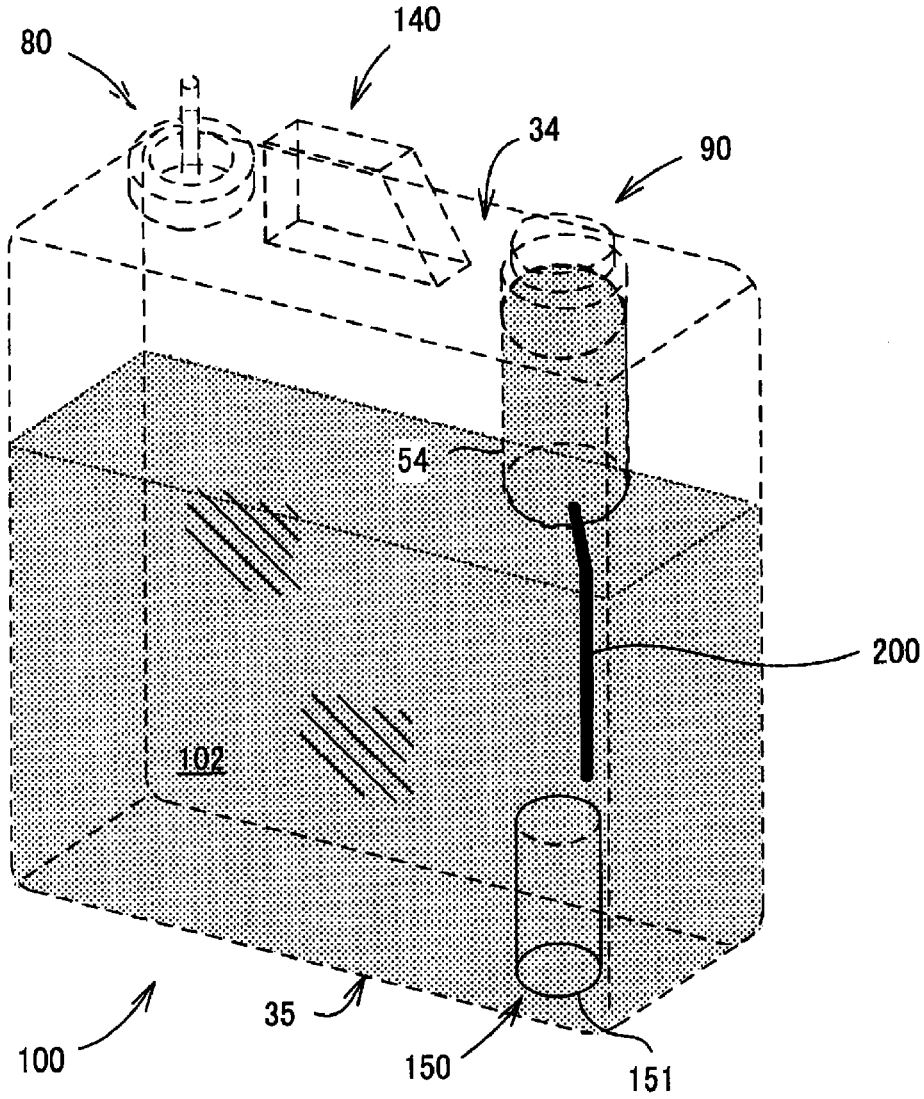
FIG. 6 is a schematic diagram showing a method of adjusting a pressure in an ink chamber of FIG. 1, according to an embodiment of the present invention.

Before the unused ink cartridge 100 is mounted to the image printing device, the pressure in the ink chamber 102 may be increased to be equal to the atmospheric pressure by the following method. The ink cartridge 100 may be positioned, such that the front wall 34 is positioned at the top of the ink cartridge 100, i.e., such that the font wall 34 faces up, as shown in FIG. 6. When this occurs, ink in the ink chamber 102 may be collected at the rear wall 35 side, and air in the ink chamber 102 may be collected at the front wall 34 side. Moreover, the opening 203 positioned at the end of the ink path 200 may be submerged in ink. After that, the rod 84 of the air introduction portion 80 may be pushed into the air introduction chamber 55, whereby the air introduction port 81 is uncovered and air is introduced via the air introduction port 81 into the ink chamber 102, such that the pressure in the ink chamber 102 is increased to be equal to the atmospheric pressure.

If air bubbles exist in the ink supply chamber 54, in the ink supply sub-chamber 107, or in the ink path 200, the volume of air bubbles decreases when the pressure in the ink chamber 102 is increased to be equal to the atmospheric pressure. When this occurs, in order to compensate for the volume difference of the air bubbles, fluid in the ink chamber 102 may be drawn to pass through the opening 203 into the ink path 200. As described above, the end of the ink path 200 reaches the end of the bottom wall 118 positioned at the rear wall 35 side, and the opening 203 may be formed through the end of the bottom wall 118 positioned at the rear wall 35 side. Moreover, the opening 203 may be positioned closer to the rear wall 35 than to the front wall 34. Therefore, the opening 203 may be submerged in ink unless the amount of ink in the ink chamber 102 is extremely small. Consequently, ink flows into the ink path 200 via the opening 203, as indicated by an arrow 44 in FIG. 3, and no air flows into the ink path 200 via the opening 203. Therefore, even when the pressure in the ink chamber 102 is increased to be equal to the atmospheric pressure, increase of the amount of air in the ink supply portion 90 may be prevented.

Because the opening 203 may be positioned adjacent to the portion of the bottom surface 171 which may be configured to contact a bottom portion of the float portion 73, i.e., the portion surrounded by a broken line in FIG. 4., and because at least a portion of opening 203 may be aligned with a portion of the float portion 73 in the gravitational direction and the opening 203 may be positioned below the float portion 73 when the ink cartridge 100 is used, even when ink is held in the gap between the bottom portion of the float portion 73 and the bottom surface 171 by the surface tension of the ink, the ink held in the gap is drawn into the ink path 200 by the current of the ink from the opening 203 into the ink path 200. Accordingly, the ink in the ink chamber 102 efficiently may be consumed.

As described above, in the above-described embodiments of the present invention, the ink cartridge 100 may comprise a particular ink path comprising a first path and a second path. The particular ink path extends from the ink supply port 91 to the opening 203. The first path of the particular ink path may comprise the ink supply chamber 54 and the ink supply sub-chamber 107. The second path of the particular ink path may comprise the ink path 200. Moreover, the ink cartridge 100 may comprise a further ink path. The further ink path may comprise the fill path 158 and the bypass 270.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case comprising:

an ink chamber defined in the case and configured to store ink;

a first wall facing an exterior of the case, wherein the first wall has a first opening formed therethrough, and a second opening formed therethrough, wherein the first opening is configured to introduce air into an interior of the ink chamber, and the second opening is configured to supply ink from an interior of the case to the exterior of the case;

a second wall facing the exterior of the case and positioned opposite the first wall;

a third wall positioned in the case and defining a portion of the ink chamber, wherein the third wall has a third opening formed therethrough, and the third opening is positioned closer to the second wall than to the first wall; and a particular ink path extending from the second opening to the third opening, wherein the particular ink path is in fluid communication with the ink chamber via the third opening.

2. The ink cartridge of claim 1, wherein the case further comprises at least one partition wall, and the particular ink path comprises:

a first path defined by the at least one partition wall and extending from the second opening; and a second path extending from the first path to the third opening.

3. The ink cartridge of claim 2, further comprising:

a first valve configured to selectively cover and uncover the first opening; and a second valve configured to selectively cover and uncover the second opening, wherein the second valve is positioned in the first path.

4. The ink cartridge of claim 2, wherein the case further comprises:

an ink fill portion; and a further ink path extending from the ink fill portion to the first path of the particular ink path.

5. The ink cartridge of claim 4, wherein the case further comprises:

a fourth wall extending between the first wall and the second wall; and a fifth wall extending between the first wall and the second wall and positioned opposite the fourth wall, wherein the particular ink path is positioned at a fourth-wall side of the case, and the further ink path is positioned at a fifth-wall side of the case.

6. The ink cartridge of claim 1, wherein the case further comprises:

an ink fill portion; and a further ink path extending from the ink fill portion to the particular ink path, wherein the further ink path is continuous with the particular ink path at a position adjacent to the second opening.

7. The ink cartridge of claim 6, wherein the case further comprises:

a fourth wall extending between the first wall and the second wall; and a fifth wall extending between the first wall and the second wall and positioned opposite the fourth wall, wherein the particular ink path is positioned at a fourth-wall side of the case, and the further ink path is positioned at a fifth-wall side of the case.

8. A method of adjusting a pressure in an ink chamber of an ink cartridge, wherein the ink cartridge comprises the ink chamber; a first wall having a first opening and a second opening formed therethrough, wherein the first opening is configured to introduce air into an interior of the ink chamber from an atmosphere, and the second opening is configured to supply ink from the interior of the ink chamber to an exterior of the ink chamber; a second wall positioned within the ink chamber and defining a portion of the ink chamber, wherein the second wall has a third opening formed therethrough; a particular ink path extending from the third opening to the second opening, wherein the particular ink path is in fluid communication with the ink chamber via the third opening; a first valve configured to selectively cover and uncover the first opening; and a second valve configured to selectively cover and uncover the second opening, the method comprising the steps of:

orienting the ink cartridge, such that the first wall is positioned at a top of the ink cartridge;

submerging the third opening in ink;

introducing air into the interior of the ink chamber from the atmosphere via the first opening by moving the first valve to uncover the first opening while the second opening is covered by the second valve; and drawing ink from the ink chamber to a position adjacent to the second opening via the particular ink path.

9. The method of claim 8 further comprises the step of reducing a pressure in the ink chamber to be less than an atmospheric pressure.

10. An ink cartridge comprising:

a case comprising:

an ink chamber defined in the case and configured to store ink;

a first wall facing an exterior of the case, wherein the first wall has a first opening formed therethrough, and the first opening is configured to supply ink from an interior of the case to the exterior of the case;

a second wall positioned in the case and defining a bottom portion of the ink chamber when the ink cartridge is used, wherein the second wall has a second opening formed therethrough; and a particular ink path extending from the first opening to the second opening, wherein the particular ink path is in fluid communication with the ink chamber via the second opening; and a movable member positioned in the ink chamber and configured to move within the ink chamber based on an amount of ink in the ink chamber, wherein at least a portion of the second opening is aligned with a portion of the movable member in a gravitational direction and the second opening is positioned below the movable member when the ink cartridge is used.

11. The ink cartridge of claim 10, further comprising a pivotable member positioned in the ink chamber, wherein the movable member is positioned at a particular end of the pivotable member, and the pivotable member is configured to pivot in accordance with a movement of the movable member.

12. The ink cartridge of claim 11, wherein the case further comprises a detection portion positioned at the first wall, wherein the detection portion has an inner space formed therein, and a particular portion of the pivotable member is positioned in the inner space of the detection portion and moves in the inner space of the detection portion when the pivotable member pivots.

13. The ink cartridge of claim 12, wherein the particular portion of the pivotable member is positioned at a further end of the pivotable member opposite the particular end of the pivotable member.

14. The ink cartridge of claim 10, wherein the case further comprises at least one partition wall, and the particular ink path comprises:

a first path defined by the at least one partition wall and extending from the first opening; and a second path extending from the first path to the second opening.

15. The ink cartridge of claim 14, wherein the case further comprises:

an ink fill portion; and a further ink path extending from the ink fill portion to first path of the particular ink path.

16. The ink cartridge of claim 15, wherein the case further comprises:

a third wall extending from the first wall; and a fourth wall extending from the first wall and positioned opposite the third wall, wherein the particular ink path is positioned at a third-wall side of the case, and the further ink path is positioned at a fourth-wall side of the case.

17. The ink cartridge of claim 10, wherein the case further comprises:

an ink fill portion; and a further ink path extending from the ink fill portion to the particular ink path, wherein the further ink path is continuous with the particular ink path at a position adjacent to the first opening.

18. The ink cartridge of claim 17, wherein the case further comprises:

a third wall extending from the first wall; and a fourth wall extending from the first wall and positioned opposite the third wall, wherein the particular ink path is positioned at a third-wall side of the case, and the further ink path is positioned at a fourth-wall side of the case.

19. An ink cartridge comprising:

a case comprising:

an ink chamber defined in the case and configured to store ink;

a first wall facing an exterior of the case, wherein the first wall has a first opening formed therethrough, and the first opening is configured to supply ink from an interior of the case to the exterior of the case;

a second wall facing the exterior of the case and positioned opposite the first wall;

a third wall facing the exterior of the case and extending between the first wall and the second wall;

a fourth wall positioned in the case and defining a portion of the ink chamber, wherein the fourth wall has a second opening formed therethrough and positioned closer to the second wall than to the first wall; and a particular ink path extending from the first opening to the second opening, wherein the particular ink path is in fluid communication with the ink chamber via the second opening; and a movable member positioned in the ink chamber and configured to move within the ink chamber based on an amount of ink in the ink chamber, wherein the second opening is positioned closer to the third wall than the movable member is positioned to the third wall, and at least a portion of the second opening is aligned with a portion of the movable member in a direction perpendicular to the third wall.

* * * * *